US005543682A

United States Patent [19]

Hara et al.

[11] Patent Number: 5,543,682

[45] Date of Patent: Aug. 6, 1996

[54] CATHODE ASSEMBLY INCORPORATING A BLACK LAYER FORMED FROM PARTICLES HAVING A SPECIFIED AVERAGE PARTICLE SIZE

[75] Inventors: Akihito Hara; Toshiharu Higuchi, both of Yokohama; Toru Yakabe, Yokosuka; Shigeo Kanda, Sagamihara; Eiji Yamamoto, Yokohama, all of Japan

[73] Assignee: Kabushiki Kaisha Toshiba, Kawasaki, Japan

[21] Appl. No.: 214,280

[22] Filed: Mar. 17, 1994

[30] Foreign Application Priority Data

| | | | |
|---|---|---|---|
| Mar. 17, 1993 | [JP] | Japan | 5-057280 |
| Jun. 17, 1993 | [JP] | Japan | 5-145980 |
| Dec. 8, 1993 | [JP] | Japan | 5-306937 |
| Dec. 8, 1993 | [JP] | Japan | 5-306938 |

[51] Int. Cl.[6] ..... H01J 29/02

[52] U.S. Cl. ..... 313/446; 313/270; 313/337; 427/126.3; 427/77

[58] Field of Search ..... 313/446, 270, 313/337, 340; 427/77, 372.2, 126.3

[56] References Cited

U.S. PATENT DOCUMENTS

| | | | |
|---|---|---|---|
| 3,823,453 | 7/1974 | Van Stratum et al. . | |
| 4,009,409 | 2/1977 | Buescher et al. | 313/340 |

FOREIGN PATENT DOCUMENTS

| | | | |
|---|---|---|---|
| 0272881 | 6/1988 | European Pat. Off. . | |
| 52-28631 | 7/1977 | Japan . | |
| 61-288339 | 12/1986 | Japan . | |
| 63-040230 | 2/1988 | Japan . | |
| 2-72533 | 3/1990 | Japan . | |
| 3105826 | 5/1991 | Japan | 313/340 |
| 3297030 | 12/1991 | Japan | 313/340 |

*Primary Examiner*—Sandra L. O'Shea
*Assistant Examiner*—Matthew J. Esserman
*Attorney, Agent, or Firm*—Cushman Darby & Cushman, L.L.P.

[57] ABSTRACT

A black coating having a uniform thickness is formed, on the inner surface of the cathode sleeve, as a sintered layer obtained by mixing tungsten having an average particle diameter in a range of 0.5 μm (inclusive) to 2 μm (inclusive) with alumina having an average particle diameter in a range of 0.1 μm (inclusive) to 1 μm (exclusive) at a weight ratio of the tungsten to the alumina in a range of (90:10) to (65:35).

3 Claims, 6 Drawing Sheets

CATHODE ASSEMBLY INCORPORATING A BLACK LAYER FORMED FROM PARTICLES HAVING A SPECIFIED AVERAGE PARTICLE SIZE

BACKGROUND OF THE INVENTION

1. Field of the Invention

The present invention relates to a cathode assembly used for an electron tube such as a color cathode ray tube and, more particularly, to an improvement in a black coating formed inside the cathode sleeve of the cathode assembly.

2. Description of the Related Art

Recently, a color cathode ray tube having a high resolution, which is achieved by increasing the number of scanning lines, and a display tube compatible with high-frequency signals have been developed. There have been demands for a projection tube and the like to increase their brightness. It is required for tubes suitable for these application purposes to greatly increase the density of electrons emitted from the cathode. A great deal of attention has been paid to an impregnated cathode because of these demands. In general, an impregnated cathode obtains a higher current density than an oxide cathode. Therefore, this impregnated cathode has been used for an electron tube such as a traveling wave tube or a klystron. As an application which effectively uses the high current density characteristics of an impregnated cathode, a color picture tube incorporating the above-mentioned impregnated cathode has recently been developed.

As is well known, the operating temperature of an impregnated cathode is higher than that of an oxide cathode by about 200° C. Accordingly, the heater temperature in the impregnated cathode is high, which reaches 1,250° C. in rated operation conditions. Consequently, thermal distortion of the heater and a deterioration in breakdown voltage performance between the heater and the cathode tend to occur. Several attempts have been made to decrease the heater temperature by increasing the efficiency of heat transfer from the heater to the cathode. For example, an impregnated cathode assembly obtained by forming a black layer containing a refractory metal or a refractory metal powder and an inorganic binder on the inner surface of a cathode sleeve is proposed in Jpn. Pat. Appln. KOKAI Publication No. 61-288339. According to this proposal, for example, a slurry or suspension obtained by adding a mixture of a tungsten powder and an aluminum oxide powder, i.e., an alumina powder, in an alumina sol in which alumina whiskers (0.1 μm×0.01 μm) are dispersed in an acetic acid solution, is coated and dried on the inner surface of a tantalum (Ta) sleeve, and the coating is sintered at a temperature of about 1,600° C. for five minutes, thus forming a black layer on the inner surface of the sleeve. In this black layer, the alumina whisker as a binder enters between tungsten grains and alumina grains to increase the bonding strength therebetween.

A cathode sleeve supporting an electron emitting portion is formed to have a very small thickness, e.g., 15 μm to 20 μm, to improve the heat efficiency by suppressing heat conduction to portions other than the electron emitting portion. If a black layer is attached to the inner surface of such a thin cathode sleeve by the above-described method, a great deterioration in strength occurs. As a result, fracture, cracking, or the like tends to occur in the manufacturing process, and deformation of the sleeve tends to occur during an operation owing to thermal fatigue. Especially when a cathode sleeve is made of tantalum (Ta) or a tantalum (Ta) alloy, it is confirmed that a compound is generated in the entire sleeve by a reaction between alumina and the tantalum (Ta) sleeve to cause a great deterioration in strength. If this sleeve is deformed during a cathode operation, the characteristics of the color cathode ray tube, especially the cutoff characteristics, are changed to cause a degradation in brightness or color misregistration. If an alumina sol having a needle-like structure is used, electric fields concentrate on the needle-like tips of alumina grains. As a result, dielectric breakdown tends to occur between the heater and the sleeve.

As a method of attaching a black coating on such a cathode sleeve, for example, a black coating forming method disclosed in Jpn. Appln. KOKOKU Publication No. 52-28631 is known. In this method, a sleeve is dipped in a slurry or suspension of a mixture of a tungsten powder and an alumina powder, and the slurry is dried. The slurry is then sintered to form a black coating. In addition, as disclosed in Jpn. Appln. KOKAI Publication Nos. 61-288339 and 2-72533, another method is known, in which a slurry of a mixture of a tungsten powder and an alumina powder is injected into a sleeve, and an unnecessary slurry is removed by vacuum suction after an elapse of a predetermined period of time. Thereafter, the slurry on the sleeve surface is dried and sintered to form a black coating.

Of the methods of attaching a black coating on a cathode sleeve, the former method of attaching a black layer on a sleeve by dipping the sleeve in a slurry of a black coating material, as disclosed in Jpn. Appln. KOKOKU Publication No. 52-28631, is suitable for the formation of a black coating on both the inner and outer surfaces of a sleeve, but there is a problem that this method is not suitable for the formation of a black coating on only the inner surface of a sleeve. In addition, this makes it difficult to ensure uniformity of the thickness of a coating. In contrast to this, the method of injecting a slurry into a sleeve, and removing an unnecessary slurry by vacuum suction, as disclosed in Jpn. Appln. KOKAI Publication Nos. 61-288339 and 2-72533, is suitable for the formation of a coating on only the inner surface of a sleeve. However, it is found that it is difficult in practice to form a black coating with a uniform thickness.

SUMMARY OF THE INVENTION

It is an object of the present invention to provide a cathode assembly with good reproducibility and high reliability, in which the mechanical strength of a cathode sleeve can be increased to exceed the strength of the material.

It is another object of the present invention to provide a coating having a uniform thickness, that coating being attached/formed on the inner surface of a cylindrical member such as a cathode sleeve with good reproducibility.

According to the present invention, there is provided a cathode assembly comprising: a cathode sleeve having an inner surface; an electron emitting portion, arranged on an end portion of the cathode sleeve, for emitting electrons; a heater, arranged inside the cathode sleeve, for heating the electron emitting portion; and a black coating formed on the inner surface of the cathode sleeve, wherein the black coating on the inner surface of the cathode sleeve is a sintered layer formed by mixing tungsten having an average particle size in a range of 0.5 μm (inclusive) to 2 μm (inclusive) with alumina having an average particle diameter in a range of 0.1 μm (inclusive) to 1 μm (exclusive) at a weight ratio of the tungsten to the alumina in a range of (90:10) to (65:35).

In addition, according to the present invention, there is provided a cathode assembly manufacturing method of forming a black coating on an inner surface of a cathode sleeve, comprising the steps of: coating a suspension on the inner surface of the cathode sleeve, the suspension being obtained by mixing tungsten having an average particle size in a range of 0.5 μm (inclusive) to 2 μm (inclusive) and alumina having an average particle size in a range of 0.1 μm (inclusive) to 1 μm (exclusive) in a dispersion at a weight ratio of the tungsten to the alumina in a range of (90:10) to (65:35); and sintering the suspension coating in a substantially nonoxidizing atmosphere at a temperature in a range of 1,250° C. to 1,580° C., thereby forming a black coating.

According to the present invention, there is provided a cathode assembly with good reproducibility and high reliability, in which the mechanical strength of a cathode sleeve is higher than the strength of the material.

Furthermore, according to the present invention, there is provided a cathode assembly manufacturing method of forming a black coating on an inner surface of a cathode sleeve, comprising the steps of: preparing a material for the black coating as a suspension by using a dispersion; filling the cathode sleeve with the suspension; bringing a porous absorbent member into contact with the suspension in an opening portion of the cathode sleeve, at the same time or after the cathode sleeve is filled with the suspension, thereby causing the porous absorbent member to absorb unnecessary portion of the suspension and attaching a black coating material to the inner surface of the cathode sleeve; and heat-treating the cathode sleeve to which the black coating material is attached.

According to the present invention, a suspension as a coating material filling a cylindrical member can be smoothly removed, and the thickness of a coating attached and left on the inner surface of the cylindrical member can be made uniform as a whole. A coating having a uniform thickness can be formed with good reproducibility and relatively high efficiency.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

FIGS. 5A to 5D are sectional views showing a black coating formed on the inner surface of the sleeve in accordance with the steps shown in FIGS. 4A to 4D, in which FIGS. 5B, 5C, and 5D are enlarged views of regions VB, VC, and VD in FIG. 5A;

FIGS. 6A to 6E are sectional views showing black coatings formed on a sleeve and its inner surface in accordance with a conventional method, in which FIGS. 6C, 6D, and 6E are enlarged views of regions VIC, VID, and VIE in FIG. 6B;

DETAILED DESCRIPTION OF THE PREFERRED EMBODIMENTS

Figure 1:
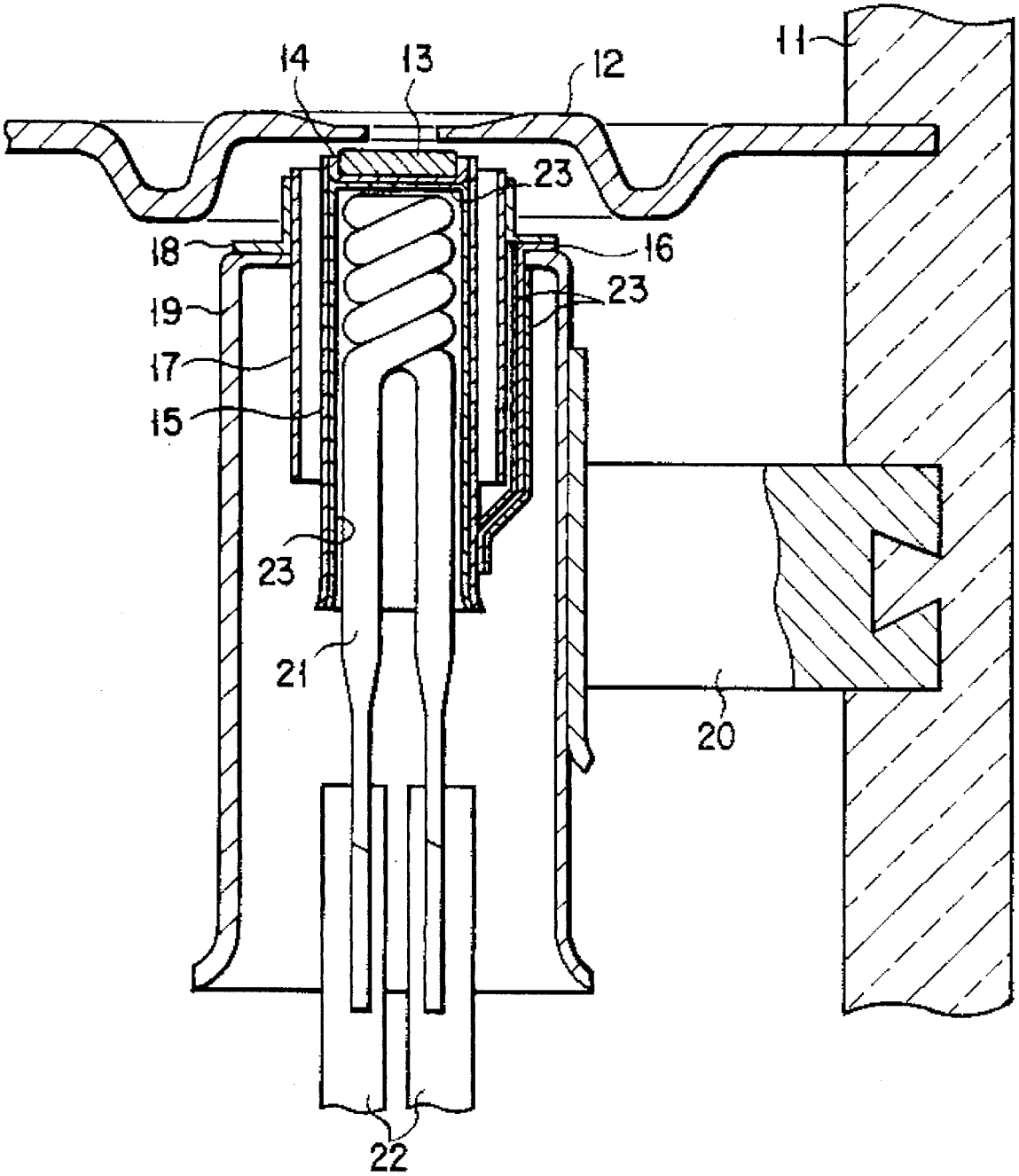
FIG. 1 is a longitudinal sectional view showing an impregnated cathode assembly constituting an electron gun assembly incorporated in a color picture tube according to an embodiment of the present invention.

An embodiment in which the present invention is applied to an impregnated cathode assembly constituting part of an electron gun assembly of a color cathode ray tube will be described below with reference to the accompanying drawings. Referring to FIG. 1, reference numeral 11 denotes a glass bead for supporting an electrode; 12, a first control grid for controlling electron emission; 13, an emitter impregnated cathode disk serving as an electron emitting portion for emitting electrons; 14, a cap for holding the disk 13; 15, a cathode sleeve having an end portion on which the disk 13 and the cap 14 are fixed; 16, three straps for supporting the cathode sleeve 15; 17, a heat reflecting cylinder for reflecting heat radiated from the sleeve 15 arranged therein; 18, a support ring 18 for supporting the heat reflecting cylinder 17; 19, a cathode holding cylinder for holding a cathode constituted by the cathode sleeve 15, the impregnated cathode disk 13, and the like; 20, a support arm for holding causing the glass bead 11 to support the cathode assembly; 21, a coiled coil type heater for heating the emitter impregnated cathode disk 13; and 22, heater terminals connected to the heater 21.

Figure 2:
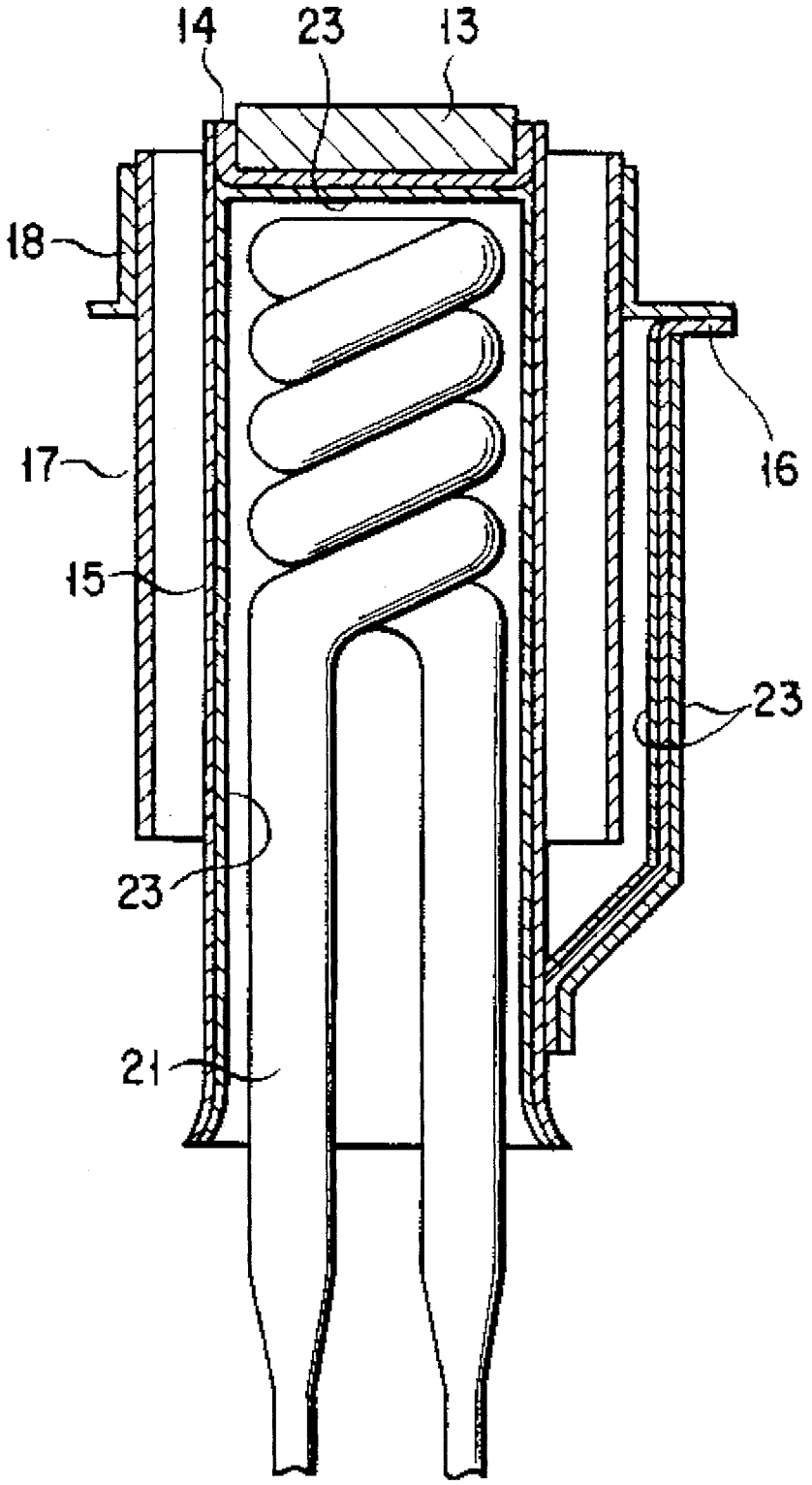
FIG. 2 is a partially enlarged sectional view of the impregnated cathode assembly in FIG. 1.

The impregnated cathode disk 13 is formed by impregnating a porous tungsten (W) substrate having a porosity of about 20% with an electron emitting substance. Note that an iridium (Ir)-tungsten (W) alloy layer is formed on the surface of the emitter impregnated cathode disk 13. The heater 21 is made of a 3% rhenium (Re)-tungsten (W) alloy wire, with alumina as an insulating material being coated on its surface. In addition, a mixture of tungsten and alumina is coated on the surface of this alumina layer to improve the heat radiation characteristics. Each of the cathode sleeve 15, the cap 14, and the three straps 16 is made of tantalum (Ta) or an alloy containing tantalum as a main component. As indicated by the enlarged view of FIG. 2, black layers or coating 23 are respectively attached/formed on the inner surface of the cathode sleeve 15, the lower surface of the cathode cap 14, and the entire surfaces of the straps.

The black layers 23 will be described next with reference to a preferred manufacturing method. A case wherein a black layer is formed on the inner surface of the cathode sleeve 15 will be mainly described below as a typical case.

EXAMPLE 1

A slurry or suspension was prepared by mixing butyl acetate and nitrocellulose with a mixture of a tungsten powder having an average particle diameter of 0.9 μm and an alumina ($Al_2O_3$) powder having an average particle size or diameter of 0.7 μm, which powders were mixed at a weight ratio of 80:20.

The slurry was coated on the inner surface of the tantalum cathode sleeve 15 by an injection method. The cathode sleeve 15 had an outer diameter of 1.3 mm, a thickness of 20 μm, and a length of 4.2 mm. The slurry was then dried. The coating in this state had an average thickness of about 10 μm.

Subsequently, the coating was heat-treated in a vacuum atmosphere of $10^{-6}$ torr or less at a temperature within the range of 1,250° C. to 1,580° C., e.g., 1,450° C., for 10 minutes, thus forming the black layer 23 made of a mixed/sintered layer consisting of a tungsten powder and an alumina powder.

Figure 3:
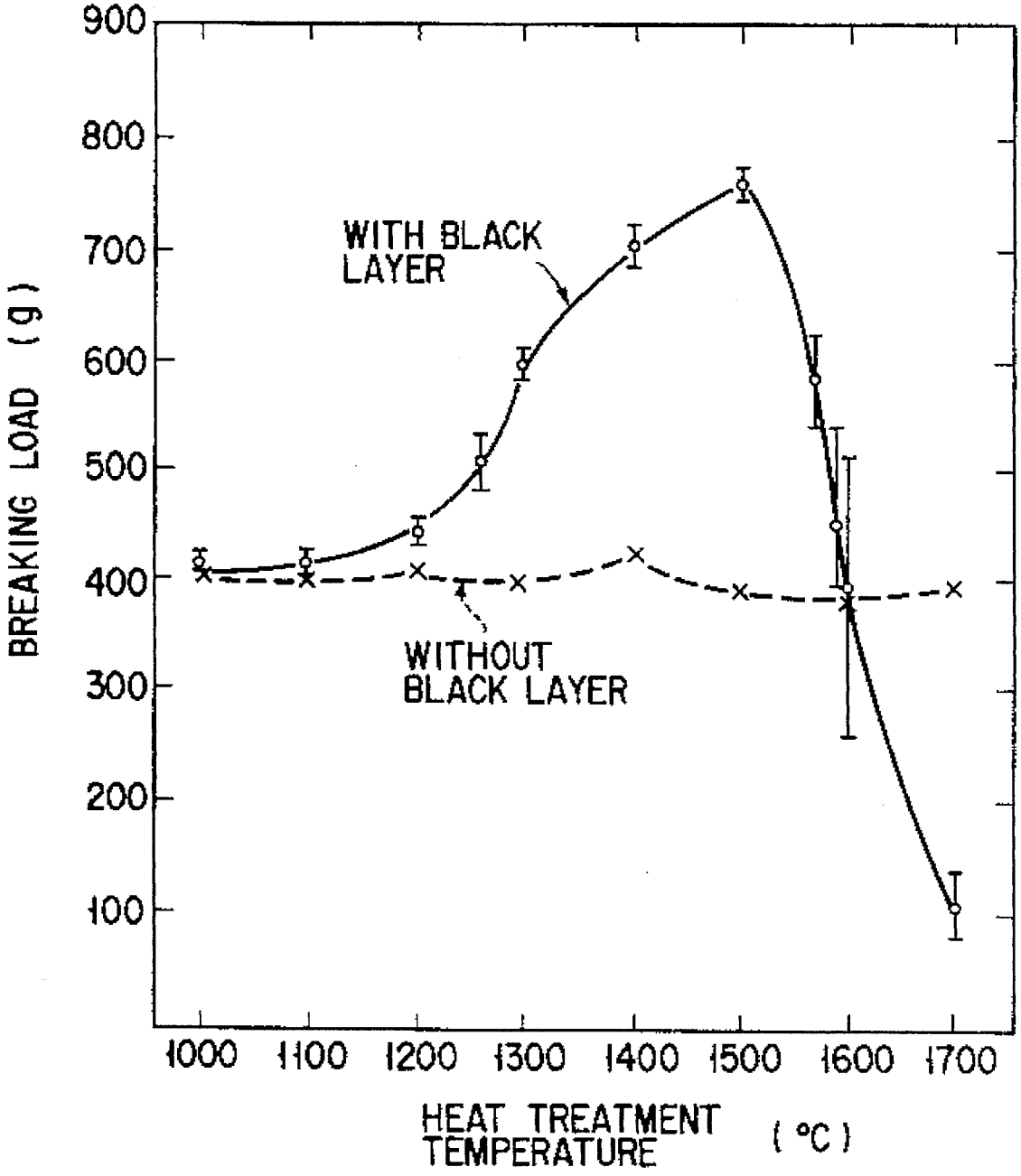
FIG. 3 is a graph showing the relationship between the heat treatment temperature and the breaking load in the impregnated cathode assembly in FIG. 1.

The conditions set for this heat treatment were determined as follows. The above-mentioned slurry was coated and dried on the entire surface of a tantalum ribbon having a width of 0.32 mm, a thickness of 30 μm, and a length of 150 mm. Thereafter, the coating was sintered in a vacuum of $10^{-6}$ torr or less at various temperatures in the range of 1,000° C. to 1,700° C. for 10 minutes, thus manufacturing ribbons having black layers formed thereon. The average thickness of the black layers was about 10 to 15 μm. For comparison, a tantalum ribbon having no slurry coated thereon was treated at the same time. The breaking strengths of the ribbons treated in the respective conditions were checked by a tensile test. As a result, the following unexpected facts were confirmed. As shown in FIG. 3, the breaking load began to increase at a treatment temperature exceeding about 1,200° C., and reached its maximum at a treatment temperature of 1,500° C. The maximum breaking load of the ribbon having the slurry coated thereon was about twice that of the ribbon having no slurry coated thereon. However, as the treatment temperature exceeded 1,500° C., the breaking load abruptly decreased. When the temperature exceeded 1,580° C., the breaking load of the tantalum ribbon having the slurry coated thereon became equal to or lower than that of the tantalum ribbon having no slurry coated thereon.

With this test, it was confirmed that the heat treatment temperature preferably fell within the range of 1,250° C. to 1,580° C. because the mechanical strength of the cathode sleeve became higher than the strength of the material. Especially, good results were obtained in terms of strength when sintering was performed at heat treatment temperatures within the range of 1,400° C. to 1,550° C. It is expected that the reason why the mechanical strength of the cathode sleeve becomes higher than the strength of the material at a heat treatment temperature within a specific range is that when a small amount of oxygen, aluminum, or tungsten in the material for the black layer is precipitated on tantalum grain boundaries in tantalum as the substrate, an abnormal increase in size of a substrate crystal or isometric crystallization is hindered.

Subsequently, in order to check whether the above-mentioned heat treatment temperature range was validated by evaluation of any other performance, the surface hardnesses of the respective ribbons having the black layers formed thereon were checked, and broken portions were observed through a scanning electron microscope. In addition, cathode sleeves were actually manufactured, and the assembly performance of each sleeve in assembling an impregnated cathode assembly was evaluated. Furthermore, each completed impregnated cathode assembly was assembled in a color picture tube, and thermal fatigue characteristics during a service life test was checked.

The results are summarized in Table 1. The results shown in Table 1 will be described in detail below. In checking the hardness of each sample, a black substance was mechanically peeled from a blackened sample, and the Vickers hardness of the surface of the substance was measured. As a result, it was found that the hardness gradually increased from a heat treatment temperature of 1,200° C. to 1,580° C. and more abruptly increased as the heat-treatment temperature exceeded 1,600° C.

From the observation of the broken portions through the scanning electron microscope, it was found that each blackened sample treated at a heat treatment temperature of 1,580° C. or less exhibited the form of ductile fracture accompanied with extension of crystals. In contrast to this, it was confirmed that each sample treated at a heat treatment temperature exceeding 1,600° C. exhibited fracture at grain boundaries, leading to brittle fracture.

The particle sizes or diameters of tungsten and alumina scarcely changed before and after sintering.

TABLE 1

| Heat-Treatment Temperature (°C.) | Hardness (MHv) | Form of Fractured Surface | Evaluation of Assembly Performance | Change in Cutoff Voltage (V) |
|---|---|---|---|---|
| 1000 | 125 | Ductile fracture | Poor (peeling of black coating | 2.7 |
| 1100 | 128 | Ductile fracture | Poor (peeling of black coating | 2.5 |
| 1200 | 130 | Ductile fracture | Good | 0.9 |
| 1250 | 135 | Ductile fracture | Good | 0.8 |
| 1300 | 149 | Ductile fracture | Good | 0.9 |
| 1400 | 159 | Ductile fracture | Good | 0.9 |

TABLE 1-continued

| Heat-Treatment Temperature (°C.) | Hardness (MHv) | Form of Fractured Surface | Evaluation of Assembly Performance | Change in Cutoff Voltage (V) |
|---|---|---|---|---|
| 1500 | 179 | Ductile fracture | Good | 0.8 |
| 1550 | 190 | Ductile fracture | Good | 1.2 |
| 1580 | 200 | Ductile fracture | Good | 1.5 |
| 1600 | 266 | Brittle fracture | Poor (cracking) | 5.5 |
| 1700 | 387 | Brittle fracture | Poor (cracking) | 10.2 |

The assembly performance of each cathode sleeve was evaluated by checking the occurrence of peeling of the black layer upon insertion of each cathode sleeve in a jig of an assembly apparatus, the occurrence of cracking of each cathode sleeve upon forcible insertion of a cathode disk inside the opening end portion of the cathode sleeve, and the like. The thermal fatigue characteristics of each cathode sleeve was evaluated by checking a change in cutoff voltage during a service life test of a color picture tube. Generally, in a picture tube, when the gap between the first grid and the cathode surface changes for some reason, the cutoff voltage changes, resulting in a change in anode current. When a cathode is used for a color picture tube, the cutoff voltages of the red, green, and blue electron guns are adjusted to be equal to each other. However, as the color picture tube is used for a long period of time, the cathode constituent material is deformed owing to thermal fatigue. As a result, the gap between the first grid and the cathode surface changes. This change in gap generally occurs to different degrees in the red, green, and blue electron guns. Therefore, the electron beam current incident on the phosphor surface changes to cause color misregistration. In addition, a degradation in brightness also occurs. For this reason, changes in size of cathode sleeves owing to thermal fatigue at various heat treatment temperatures were checked by a heating/cooling test on the cathode of each color picture tube. In this test, an applied heater voltage was determined such that the ultimate temperature of each cathode was about 1,150° C. This test was repeatedly performed while the power was alternately kept ON for five minutes and OFF for ten minutes. Since a change in gap between the cathode surface and the first grid is almost proportional to the amount of change in cutoff voltage, distortion of each sleeve, caused by thermal fatigue, can be accurately measured by measuring the amount of change in cutoff voltage. A change in cutoff voltage was determined from a result obtained by repeating the ON/OFF operation 4,000 times.

As is apparent from Table 1, it is confirmed, from the degree of variation in cutoff voltage, that temperatures in the range of 1,250° C. to 1,580° C. are proper as heat treatment temperatures for the formation of black layers.

EXAMPLE 2

Tungsten and alumina powders having different particle diameters, which were used to form black layers 23, were prepared. Samples constituted by various combinations of these powders were manufactured and evaluated. Seven types of tungsten powders respectively having average particle sizes of 0.1 μm, 0.5 μm, 0.9 μm, 2 μm, 3 μm, 5 μm, and 10 μm were prepared. A total of nine types of alumina powders were prepared, i.e., a fine alumina powder (average size: (e.g. diameter) about 0.01 μm) and alumina powders respectively having average particle sizes (e.g. diameters) of 0.1 μm, 0.3 μm, 0.5 μm, 0.6 μm, 0.8 μm, 1.0 μm, 2 μm, and 5 μm. Note that after the slurries were dried, all the coatings were heat-treated in a processing atmosphere of the same degree of vacuum at 1,450° C.

Table 2 shows the result of the test using the various combinations of the powders.

TABLE 2

| Average Particle Diameter of Tungsten (μm) | Average Particle Diameter of Alumina (μm) | Bonding Strength | Breakdown voltage (kv) |
|---|---|---|---|
| 0.9 | Fine alumina Powder | High | 0.7 |
| 0.9 | 0.1 | High | 1.4 |
| 0.9 | 0.3 | High | 1.5 or more |
| 0.9 | 0.5 | High | 1.5 or more |
| 0.9 | 0.8 | High | 1.5 or more |
| 0.9 | 1.0 | Almost high | 1.5 or more |
| 0.9 | 2 | Slightly low | 1.5 or more |
| 0.9 | 5 | Low (peeling) | 1.5 or more |
| 0.1 | 0.6 | Low (cracking) | 1.3 |
| 0.5 | 0.6 | High | 1.5 or more |
| 0.9 | 0.6 | High | 1.5 or more |
| 2 | 0.6 | High | 1.5 or more |
| 2 | 1.0 | Almost high | 1.5 or more |
| 3 | 0.6 | Slightly low | 1.5 or more |
| 3 | 1.0 | Low (peeling) | 1.4 |
| 5 | 0.6 | Low (cracking) | 1.3 |
| 10 | 0.6 | Low (cracking) | 1.3 |

In evaluating these samples, the adhesive strengths of the black layers 23 and the breakdown voltages between the heaters and the cathodes were measured after the heat treatment. The adhesive strength of each black layer was determined by checking a peeled state of the layer after the coating was scratched by a needle with a pointed end. In evaluating the breakdown voltage of each sample, five impregnated cathode assemblies were assembled, and these assemblies were incorporated in cathode ray tubes. A DC voltage was then applied between the heater and the cathode of each picture tube, and a discharge voltage was measured, thus evaluating the breakdown voltage. Note that in this test, evaluation was performed by setting the heater heating voltage to be 1.1 times the rated voltage.

As is apparent from Table 2, it is preferable, from the viewpoint of adhesive strength and breakdown voltage, that a tungsten powder have an average particle diameter in the range of 0.5 μm to 2 μm. In addition, it is preferable that an alumina powder have an average diameter in the range of 0.1 μm to 1 μm. The reason why the breakdown voltage performance of the sample using the fine alumina powder was very low seems to be that when alumina particles having pointed ends are used, electric fields tend to concentrate on the ends of the fine particles.

EXAMPLE 3

In Example 3, a target is an impregnated cathode assembly having black layers formed on the inner surface of the cathode sleeve and on the entire surfaces of the straps. As a method of forming a black layer on the inner surface of the cathode sleeve, the method described in the above example was employed. Each strap was made of tantalum and had a width of 0.2 mm and a thickness of 0.02 mm. A black layer 23 having an average thickness of 3 μm was formed on the entire surface of this strap member. A tungsten powder having an average particle size of 0.9 μm and an alumina powder having an average particle size of 0.6 μm were used. After a slurry was coated and dried, the coating was sintered in a vacuum atmosphere at 1,450° C.

The impregnated cathode assembly manufactured in this manner was assembled in a picture tube, and a change in cutoff voltage during a service life test was checked. The same evaluation conditions as those described above (Example 1) were set. Table 3 shows the result.

TABLE 3

| Sample | Change in Cutoff voltage (V) |
|---|---|
| Strap with black coating | 0.7 |
| Strap without black coating | 1.2 |

As is apparent from Table 3, when a black layer 23 is also formed on each strap, the mechanical strength of the strap becomes higher than the strength of the material. Therefore, the change in cutoff voltage can be reduced.

EXAMPLE 4

In Example 4, a target is also an impregnated cathode assembly having a black layer formed on the inner surface of the cathode sleeve by using a tungsten powder and an alumina powder. In Example 4, samples were manufactured and evaluated while the weight ratio of a tungsten powder to an alumina powder, which powders were used to form a black layer, was variously changed. A tungsten powder having an average particle diameter of 0.9 μm and an alumina powder having an average particle diameter of 0.8 μm were used. After the slurries were coated and dried, all the coatings were heat-treated in a vacuum atmosphere at 1,450° C. for 10 minutes.

In evaluating each samples in Example 4, the outer appearance of the black layer after the heat treatment, the adhesive strength, and the heater temperature at which the cathode temperature became 1,100° C. were measured. The adhesive strength of each black layer was determined by checking a peeled state of the layer after the coating was scratched by a needle with a pointed end. In measuring the temperature of each cathode, each sample was assembled in an impregnated cathode assembly, and a dummy tube having a heater inserted therein was manufactured. Table 4 shows the result.

TABLE 4

| Composition (wt %) | | | Evaluation of | Heater Temperature at Which Cathode |
|---|---|---|---|---|
| Tungsten powder | Alumina powder | Outer Appearance | Bonding Strength | temperature Becomes 1,100° C. (°C.) |
| 95 | 5 | Black | Poor (peeling) | 1250 |
| 90 | 10 | Black | Good | 1219 |
| 85 | 15 | Black | Good | 1220 |
| 80 | 20 | Black | Good | 1217 |
| 70 | 30 | Black | Good | 1240 |
| 65 | 35 | Slightly Black | Good | 1245 |
| 60 | 40 | Gray | Good | 1255 |
| 50 | 50 | Gray | Slightly poor (peeling) | 1290 |
| 40 | 60 | Gray | Poor (peeling) | 1318 |
| 0 (No black layer) | 0 | — | — | 1368 |

As is apparent from Table 4, it is preferable, from the viewpoint of the adhesive strength of a black layer and cathode temperature characteristics, that the weight ratio of a tungsten powder to an alumina powder (tungsten:alumina) falls within the range of (90:10) to (65:35). Especially, when the weight ratio of tungsten to alumina (tungsten:alumina) falls within the range of (70:30) to (85:15), better performance can be obtained.

Another Embodiment

In the above embodiment, a tantalum (Ta) material was used for a cathode sleeve and a strap member. However, the present invention is not limited to this. For example, the same effects as those of the above-described embodiment were obtained by using a tantalum (Ta) alloy mainly consisting of tantalum (Ta) containing 10 wt % of tungsten (W) or a tantalum (Ta) alloy mainly consisting of tantalum (Ta) containing 2.5 wt % of tungsten (W). Alternatively, a tantalum (Ta) alloy containing 40 wt % of niobium (Nb) may be used. In addition, niobium (Nb) may be used for this cathode sleeve. Alternatively, the cathode sleeve may be made of an alloy mainly consisting of niobium (Nb), and containing 15 wt % or less of at least one component selected from the group consisting of titanium (Ti), zirconium (Zr), hafnium (Hf), vanadium (V), tantalum (Ta), molybdenum (Mo), and tungsten (W).

As described above, at least one element selected from the group consisting of V, Nb, Ta, which are 5A group elements in the Periodic Table, Cr, Mo and W, which are 6A group elements in the Periodic Table, can be used for forming the cathode sleeve and the strap material. It is also possible to use as the particular material an alloy containing at most 15% by weight of at least one of the elements given above.

In the above-described embodiment, black layers are formed on a cathode sleeve and strap members. However, a black layer 23 may be formed on the lower surface of a disk holding cap. With this process, the strength of the cathode assembly can be increased. In addition, since the heat conduction through the cap is improved, the effect of decreasing the heater temperature is enhanced.

The present invention is not limited to an impregnated cathode assembly and may be applied to other types of cathodes, e.g., an indirectly heated cathode and a directly heated cathode. Furthermore, in addition to a tungsten powder and an alumina powder, other heat-resistive powders may be contained in several wt % or less. In the present invention, even if no alumina whisker is mixed in a black layer, fine particles in the black layer are attached to each other with a sufficient bonding strength. In addition, this layer is reliably attached to the inner surface of the sleeve.

A method of attaching/forming a black coating on the inner surface of the sleeve of an electron emitting cathode incorporated in a calor image tube will be described next. Note that the same reference numerals in the drawings used in the following description denote the same parts as in FIGS. 1 and 2, and a detailed description thereof will be omitted.

Figure 4A:
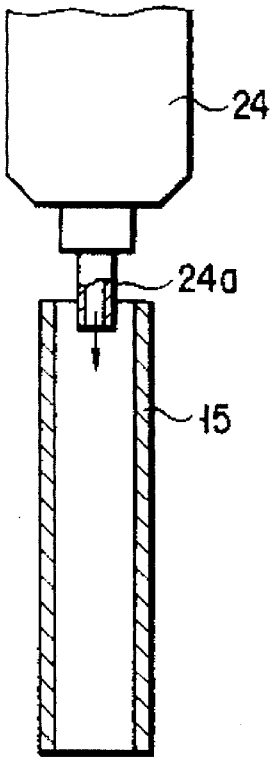
FIGS. 4A to 4D are longitudinal sectional views showing the steps in a method of attaching/forming a black coating on the inner surface of a sleeve of an impregnated cathode assembly according to an embodiment of the present invention.

As shown in FIG. 4A, as a cylindrical member, i.e., a cathode sleeve 15, an elongated tantalum pipe having a thickness of 15 μm, a diameter of 1.2 mm, and a length of 4.2 mm is prepared. This cathode sleeve 15 is set in a vertical position. A nozzle 24*a* of a syringe 24 is then inserted in the cathode sleeve 15 from above, and a predetermined amount of a suspension 25 as a black coating material is injected in the direction indicated by the arrow in FIG. 4A. The suspension 25, as a material for a black coating layer 23, is obtained by mixing butyl acetate and nitrocellulose as dispersions with a mixture of a tungsten powder having an average particle size of 0.9 μm and an aluminum oxide powder, i.e., an alumina powder, having an average particle diameter of 0.7 μm at a weight ratio of about 80:20. In this case, the weight ratio of the mixture of the tungsten and alumina powders to the dispersions is about 50:50.

Figure 4B:
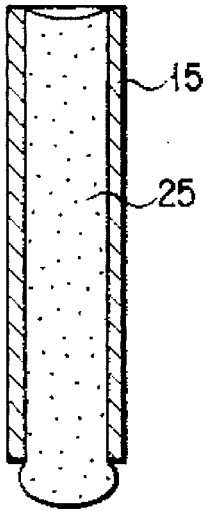

As shown in FIG. 4B, the cathode sleeve 15 is filled with the suspension 25. The suspension 25 slightly protrudes downward from the plane of the lower opening portion of the cathode sleeve 15 owing to the balance between surface tension and gravity.

Figure 4C:
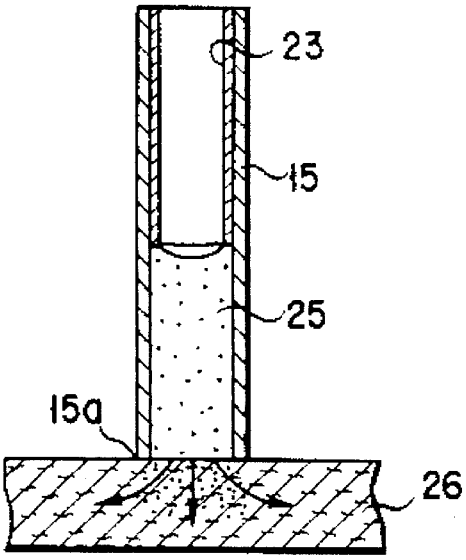
Figure 4D:
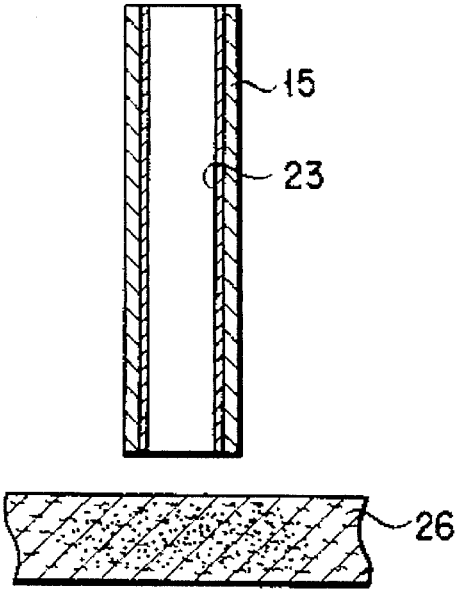
Figure 5A:
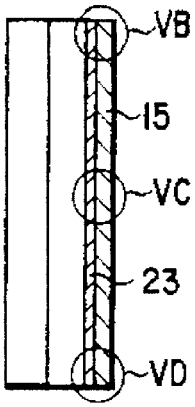
Figure 5B:
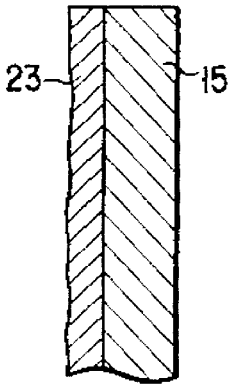
Figure 5C:
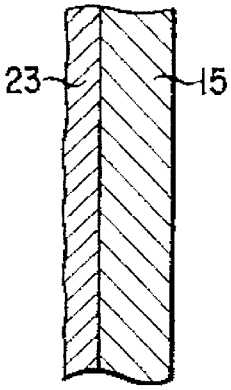
Figure 5D:
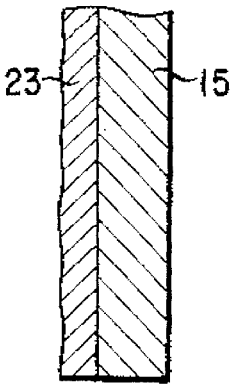

After the state in which the sleeve is filled with the suspension is kept for a predetermined period of time, e.g., five seconds, a porous absorbent member 26 is brought near or into contact with a lower opening end face 15*a* of the sleeve 15 to quickly absorb the suspension 25 in the sleeve 15, as shown in FIG. 4C. Although most of the suspension 25 flows into the porous absorbent member 26 owing to capillarity, as indicated by the arrows in FIG. 4C, a black coating 23 having a predetermined thickness is attached/left on the inner surface of the cathode sleeve 15. When an unnecessary portion of the suspension is completely absorbed by the porous absorbent member 26, the cathode sleeve 15 is separated from the porous absorbent member 26, as shown in FIG. 4D.

The porous absorbent member 26 used in this process is cotton paper having a thickness of about 3 mm. The initial speed at which water is absorbed by the porous absorbent member 26, i.e., the initial speed of water absorption, is about 8.7 mm/sec, and the initial speed of suspension absorption is about 1.7 mm/sec. In this case, the speed of water or suspension absorption means an average absorption height attained three seconds after the start of absorption. This average absorption height was measured in the following manner.

(1) Five rectangular porous absorbent members, each having a width of 15 mm and a length of 120 mm, were prepared as test pieces.

(2) Measurement was performed in the atmosphere. Vessels respectively containing distilled water and the suspension used in this embodiment were prepared, and the temperature of each liquid was set to be 20° C.

(3) A marked line was drawn on each test piece at a position separated from a short side by 5 mm to be parallel thereto, and the test piece was set in a vertical position. Each test piece was quickly dipped in the water up to the marked line. The heights from the marked line to the central positions, in the widthwise direction of the test piece, to which the water rose for three seconds, respectively, were read in mm. A length measuring device was held parallel to each test piece so as not be brought into contact therewith during a measuring operation.

(4) The absorption heights to which the water rose for three seconds, respectively, were expressed in mm. The initial speed of absorption was defined by an absorption height per second of an absorption height attained for three seconds after the start of absorption, and was expressed in (mm/sec).

A black material coating layer 23 which was attached to the inner surface of the cathode sleeve in this manner was dried. The black material coating layer 23 was then heat-treated in a vacuum atmosphere of about $10^{-6}$ torr at 1,450° C. for 10 minutes, thus obtaining a black coating layer 23 made of a mixed/sintered layer of the tungsten powder and the alumina powder.

The black coating layer 23 boned/formed on the inner surface of the cathode sleeve in this manner has a uniform thickness of about 5 μm. When the completed cathode sleeve 15 was vertically cut and observed through a microscope, the thickness of the black coating layer 23 on two end portions and a middle portion of the sleeve was very uniform, with projections/recesses having sizes of 0.5 μm or less, as shown in FIGS. 5A, 5B, 5C, and 5D. In addition, the particle diameters of the tungsten and alumina powders did not change after sintering.

Figure 6A:
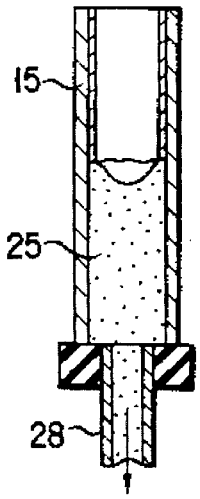
FIG. 6A (PRIOR ART)
Figure 6B:
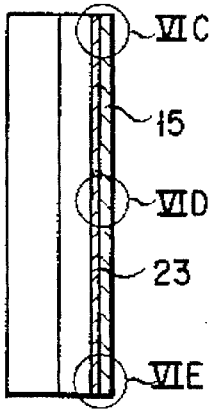
FIG. 6B (PRIOR ART)
Figure 6C:
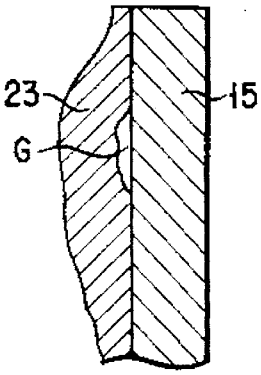
FIG. 6C (PRIOR ART)
Figure 6D:
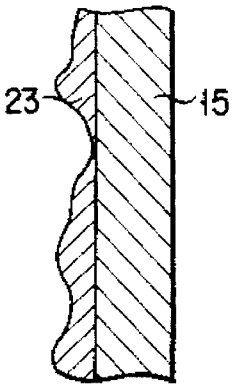
FIG. 6D (PRIOR ART)
Figure 6E:
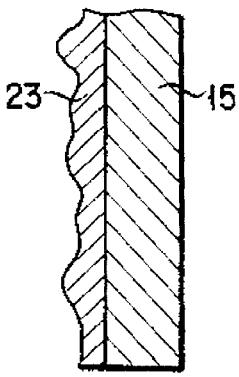
FIG. 6E (PRIOR ART)

In contrast to this, upon checking a black coating obtained by removing a suspension from a cathode sleeve by a known suction method, as shown in FIG. 6A, it was confirmed that the coating had a nonuniform thickness, and an undesirably thick coating was attached near the opening end portion, as shown in FIGS. 6B, 6C, 6D, and 6E. FIGS. 6C, 6D and 6E are enlarged views showing regions VIC, VID and VIE shown in FIG. 6B. More specifically, as shown in FIG. 6A, after a suspension 25 was injected into a sleeve 15, the suspension was sucked and removed from the lower opening end by a suction unit 28. This cathode sleeve was dried and heat-treated in the same manner as described above, thus obtaining a black coating 23 made of a mixed/sintered layer. When the black coating 23 was observed through the microscope, it was found that the black coating 23 on the inner surface of the opening end portion shown at an upper position in FIG. 6C was abnormally thick, and a portion of the coating floated from the inner surface to form a gap G. In addition, portions of the coating on the middle portion and the other opening end portion conspicuously had nonuniform projections/recesses and nonuniform thicknesses, and there was a surface portion on which no coating was formed. When a suction was sucked with the suction unit in contact with the upper end of the sleeve, an abnormally thick coating was contrarily attached to a portion near the lower opening end portion of the sleeve. This may indicate that the suspension on an end portion on the opposite side of the sleeve to the end portion where suction takes place is not quickly sucked/removed, and a large amount of the suspension tends to remain adhering to the surface. In addition, the coating tends to float and partly peel off. When the suction force was increased to prevent this, turbulence of air occurred in the sleeve. As a result, the thickness of the coating became nonuniform, and coating spots formed by partial omission of the coating was recognized.

A material suitable for a porous absorbent member was determined on the basis of the following checking. A suspension as a coating material was charged into a cathode sleeve. This state was held for five seconds. Thereafter, as absorbent members, Japanese calligraphy paper, general printing paper, general writing paper, general drawing paper, tissue paper, cotton paper, a sponge for washing dishes, nylon cloth, and cotton cloth were respectively brought into contact with the opening end face of the cathode sleeve to suck the suspension. The attached state of each coating on the inner surface of the sleeve was then observed. In addition, heat treatment was performed in the same manner as described above. Thereafter, the assembly operations based on forcible insertion of a cathode disk and a cap in one end of each cathode sleeve were compared with each other. 15 impregnated cathode assemblies were then assembled for each absorbent member, and the assemblies were respectively incorporated in color picture tubes, thus comparing their breakdown voltage values. The assembly performance of each sample was evaluated by checking the occurrence of peeling of the black coating upon insertion of the cathode disk and the cap into the cathode sleeve, and the occurrence of cracking of the cathode sleeve. In evaluating the breakdown voltage performance of each sample, the heater heating voltage was set to be 1.1 times the rated voltage, and a DC voltage was applied between the cathode sleeve and the heater, thus measuring a discharge starting voltage. Note that removal of suspensions was also performed by a suction method and an air blowing method, respectively, and comparison was performed in the same manner as described above.

Table 5 shows the result.

TABLE 5

| Material (Removal Used to Remove Suspension | | Attached State of Coating | Assembly Performance of Cathode After Heat Treatment | Breakdown Voltage Performance (Average; kV) |
|---|---|---|---|---|
| Cotton Paper 1 | | Uniform | Good | 1.5 or more |
| Cotton Paper 2 | | Uniform | Good | 1.5 or more |
| Cotton cloth | | Uniform | Good | 1.5 or more |
| Tissue paper | | Slightly thicker on side opposite to suction side | Slightly good | 1.4 |
| Paper Wiper | | Slightly thicker on side opposite to suction side | Slightly good | 1.4 |
| Japanese paper | | Thicker on side opposite to suction side | Poor (peeling of coating) | 0.9 |
| Japanese calligraphy paper | | Thicker on side opposite to suction side | Poor (peeling of coating) | 0.9 |
| Sponge | | Thicker on side opposite to suction side | Poor (peeling of coating) | 1.1 |
| Paper filter | | Thicker on side opposite to suction side | Poor (peeling of coating) | — |
| Nylon cloth | | Thicker on side opposite to suction side | Poor (cracking) | — |
| Printing paper | | Suspension cannot be removed | — | — |
| Writing paper | | Suspension cannot be removed | — | — |
| Drawing paper | | Suspension cannot be removed | — | — |
| Vacuum suction | Suction rate 10 cc/sec. | Coating spots, residue on side opposite to suction side, and floating of coating | Poor (peeling of coating) | 1.0 |
| | 20 cc/sec. | Coating spots, residue on side opposite to suction side, and floating of coating (conspicuous) | Poor (cracking) | — |
| Air blowing | Blowing pressure 2 kg/cm$^2$ | Conspicuous coating spots (ripple mark) | Poor (cracking) | — |
| | 5 kg/cm$^2$ | Conspicuous coating spots (ripple mark) | Poor (peeling of coating) | 0.7 |

As is apparent from Table 5, the cotton paper and the cotton cloth are the best porous absorbent members that can form a high-quality coating having a uniform thickness and ensures good assembly performance and good breakdown voltage performance. The tissue paper and Paper Wiper as a kind of paper cloth are the second best materials. Note that cotton paper available as "Bemcot" from ASAHI CHEMI- CAL INDUSTRY CO., LTD. was suitable for this porous absorbent member. In addition, general absorbent wadding as a kind of cotton cloth exhibits a good absorbency with respect to a suspension, and hence can be used if a careful consideration is given to fiber tear.

In contrast, the Japanese calligraphy paper, the sponge, and the nylon cloth had low speeds of absorption. With these porous absorbent members, a thick coating tended to be formed on an end portion on the opposite side of a cathode sleeve to the opening end portion where suction took place. The printing paper, the writing paper, and the drawing paper had considerably poor absorbencies, and no coating was formed. In the method of sucking/removing a suspension by suction, a residue remained around the opening end portion, and floating of the coating occurred. In addition, coating spots were formed. In the method of removing a suspension by blowing air, a ripple mark was formed on the coating surface, and large coating spots were formed.

Table 6 shows the absorption hights with water and suspension and the initial speeds of absorptions obtained by measuring various porous absorbent members by the above-described measurement method. As is apparent from Table 6, a material having an initial speed of water absorption of not less than 3 mm/sec is a proper porous absorbent member, and a further preferable material is the one which has an initial speed of water absorption of not less than 7 mm/sec.

TABLE 6

| Porous Absorbent Member | Absorption Height with Water (20° C.) after 3 sec [mm] | Initial Speed of Wafer Absorption [mm/sec] | Absorption Height with Suspension (20° C.) [mm] | Initial Speed of Absorption (Slurry) [mm/sec] |
|---|---|---|---|---|
| Cotton paper 1 | 26 (24–28) | 8.7 | 5 (4–6) | 1.7 |
| Cotton cloth | 23 (21–25) | 7.7 | 4 (3–6) | 1.3 |
| Cotton paper 2 | 22 (21–25) | 7.3 | 4 (3–5) | 1.3 |
| Tissue paper | 13 (11–14) | 4.3 | 3 (3–4) | 1.0 |
| Paper Wiper | 10 (9–12) | 3.3 | 3 (2–5) | 1.0 |
| Japanese paper | 8 (7–8) | 2.7 | 2 (1–2) | 0.7 |
| Paper filter | 5 (4–6) | 1.7 | 1 or less | 0.3 or less |
| Nylon cloth | 3 (2–4) | 1.0 | 1 or less | 0.3 or less |

As a coating material used as a suspension, a fine powder preferably having an average particle diameter of 2 μm, more preferably 1.2 μm, is suitable for the formation of a coating with a uniform thickness. Note that the thickness of a coating can be controlled by changing the amount of a fine powder contained in a suspension. However, if the amount of a fine powder is too large, the formation of a coating tends to be influenced by an operation environment, and variations in thickness of coatings in mass production are increased. It is, therefore, desired that the concentration of a fine powder fall within a proper concentration range. In the case of a suspension constituted by a high-melting fine powder such as a tungsten or alumina powder and a dispersion, a practical concentration range corresponded to the range of 30:70 to 70:30 as the weight ratio of the high-melting fine powder and the dispersion.

Figure 7:
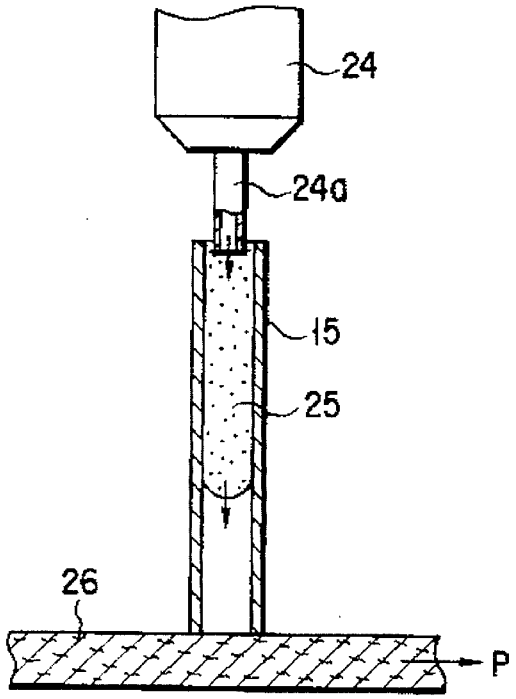
FIG. 7 is a longitudinal sectional view showing a step in a method of attaching/forming a black coating on the inner surface of a sleeve of an impregnated cathode assembly according to an embodiment of the present invention.

The embodiment shown in FIG. 7 is associated with a method of forming a coating, which is suitable for an elongated sleeve 15 on which a coating is to be formed. More specifically, a porous absorbent member 26 is kept in contact with the lower opening end face of the sleeve 15 in advance, and a suspension 25 is injected into the sleeve 15 from above. The sleeve 15 is sequentially filled with the suspension from above. At the same time when the suspension is spread on the entire inner surface of the sleeve 15, the leading end of the liquid is brought into contact with the porous absorbent member 26. As a result, the suspension is quickly absorbed by the porous absorbent member 26. By properly setting the injection rate of the suspension 25, the time during which the entire inner surface of the sleeve 15 are in contact with the suspension can be substantially equalized, thereby making the thickness of the attached coating more uniform.

The suspension may be absorbed by the porous absorbent member 26 while the member is moved in the direction indicated by an arrow P. With this operation, a substantially infinite amount of a suspension can be absorbed by a porous absorbent member. Alternatively, a porous absorbent member may be placed at a set position to cause it to absorb a suspension. After an elapse of a predetermined period of time, the porous absorbent member is separated from the sleeve and moved by a predetermined distance to bring it into contact with the sleeve again, thereby causing the porous absorbent member to absorb the suspension. This operation may be repeated. This equally applies to the other embodiments. According to the method of continuously or intermittently moving a porous absorbent member, a uniform coating can be formed on the inner surface of a considerably long sleeve with high reproducibility.

Figure 8A:
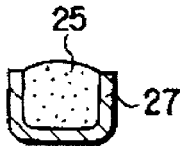
FIGS. 8A, 8B, and 8C are longitudinal sectional views respectively showing main portions in the steps in a method of forming a coating on the inner surface of a cap with a bottom according to an embodiment of the present invention.
Figure 8B:
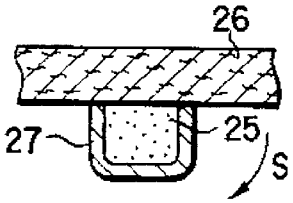
Figure 8C:
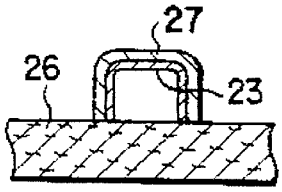

The embodiment shown in FIGS. 8A, 8B, and 8C is associated with a method of forming a coating on the inner surface of a cap 27 with a bottom as a cylindrical member. As shown in FIG. 8A, the cap 27 having the bottom is placed with its opening facing up, and a suspension 25 as a coating material is injected to fill the cap 27. Subsequently, as shown in FIG. 8B, a porous absorbent member 26 is brought into contact with the opening of the cap 27. The cap 27 having the bottom and the porous absorbent member 26 are quickly reversed as indicated by an arrow S, thus causing the porous absorbent member 26 to absorb the suspension 25. As shown in FIG. 8C, with this operation, a coating 23 can be uniformly attached to the inner surface of the cap 27. The coating is then subjected to predetermined heat treatment.

According to this embodiment, a coating having a uniform thickness can be formed on the inner surface of a cylindrical member with a bottom, which has a relatively large diameter and a small depth, with high reproducibility.

Figure 9A:
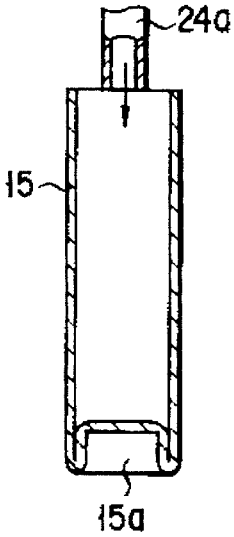
FIGS. 9A, 9B, and 9C are longitudinal sectional views respectively showing main portions in the steps in a method of forming a coating on the inner surface of a cap with a bottom according to another embodiment of the present invention.
Figure 9B:
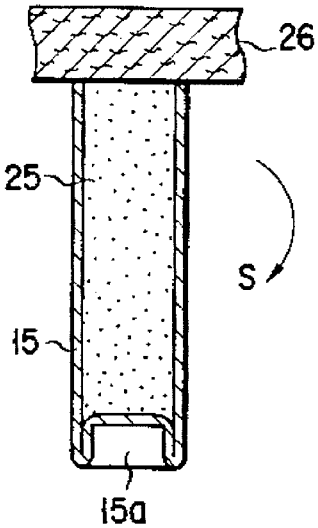
Figure 9C:
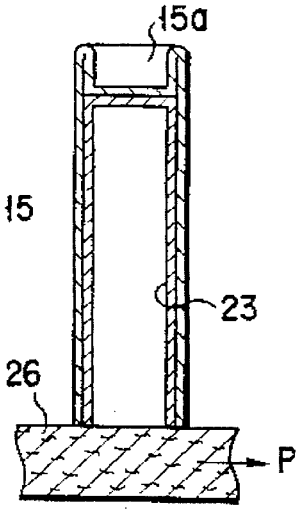

The embodiment shown in FIGS. 9A, 9B, and 9C exemplifies a case wherein a coating is formed on the inner surface of a relatively long cylindrical member with a bottom. As shown in FIG. 9A, a cylindrical sleeve 15 with a bottom is prepared by depressing the bottom wall of one end portion of a cylindrical member inward to form a recess portion 15*a* with a bottom, in which an emitter impregnated disk is inserted/fixed. A suspension as a coating material is injected into the sleeve 15 from the nozzle 24*a* of the syringe 24, which is located at the opening side. When the sleeve 15 is filled with the suspension, a porous absorbent member 26 is brought into contact with the opening of the sleeve 15 to be fitted thereon, as shown in FIG. 9B. The sleeve 15 and the porous absorbent member 26 are quickly set upside-down, as indicated by an arrow S, thereby causing the porous absorbent member 26 to absorb the suspension 25. With this operation, as shown in FIG. 9C, a coating 23 can be uniformly attached to the inner surface of the cylindrical cap 27. If the porous absorbent member 26 is continuously or intermittently moved in the manner as described above, since air enters the sleeve 15 through a unused portion of the porous absorbent member in place of the suspension, the suspension can be smoothly absorbed and removed even from the sleeve with the bottom. Therefore, this operation is more preferable. The coating is then subjected to heat treatment.

If no coating is to be formed on a specific portion of the inner surface of a sleeve, the surface of the portion is covered with a mask. If this portion is an opening end portion, injection of a suspension is stopped halfway. With this operation, a coating can be selectively formed.

In the above embodiment, a black coating is formed on the inner surface of a cylindrical member as a portion of an electron emitting electrode. However, the present invention is not limited to this. The present invention can be applied to cases wherein coatings for other purposes or having other characteristics are attached/formed on the inner surfaces of cylindrical members.

As has been described above, according to the present invention, there is provided a highly reliable cathode assembly with excellent reproducibility, in which the mechanical strength of a cathode sleeve is higher than the strength of the material therefor. In addition, according to the present invention, a coating having a uniform thickness can be formed on the inner surface of a cylindrical member with high reproducibility and relatively high efficiency.

Additional advantages and modifications will readily occur to those skilled in the art. Therefore, the invention in its broader aspects is not limited to the specific details, and illustrated examples shown and described herein. Accordingly, various modifications may be made without departing from the spirit or scope of the general inventive concept as defined by the appended claims and their equivalents.

What is claimed is:

1. A cathode assembly comprising:

a cathode sleeve having an inner surface;

an electron emitting portion, arranged on an end portion of said cathode sleeve, for emitting electrons;

a heater, arranged inside said cathode sleeve, for heating said electron emitting portion; and a black coating formed on the inner surface of said cathode sleeve, wherein said black coating on the inner surface of said cathode sleeve is a sintered layer formed by mixing tungsten having an average particle diameter in a range of 0.5 μm (inclusive) to 2 μm (inclusive) with alumina having an average particle diameter in a range of 0.1 μm (inclusive) to 1 μm (exclusive) at a weight ratio of the tungsten to the alumina in a range of (90:10) to (65:35).

2. An assembly according to claim 1, wherein said cathode sleeve is made of a component selected from the group consisting of tantalum, an alloy containing tantalum as a main component, niobium, and an alloy containing niobium as a main component.

3. An assembly according to claim 1, wherein the weight ratio of the tungsten to the alumina (tungsten:alumina) is in a range of (70:30) to (85:15).

* * * * *